United States Patent [19]

Lytle

[11] Patent Number: 5,041,023

[45] Date of Patent: Aug. 20, 1991

[54] CARD EDGE CONNECTOR

[75] Inventor: Thomas G. Lytle, Danbury, Conn.

[73] Assignee: Burndy Corporation, Norwalk, Conn.

[21] Appl. No.: 481,418

[22] Filed: Feb. 16, 1990

Related U.S. Application Data

[60] Continuation-in-part of Ser. No. 324,388, Mar. 15, 1989, abandoned, which is a division of Ser. No. 146,858, Jan. 22, 1988, Pat. No. 4,846,734.

[51] Int. Cl.[5] ..... H01R 23/70

[52] U.S. Cl. ..... 439/637; 439/886

[58] Field of Search ..... 439/59-63, 439/629-637, 886

[56] References Cited

U.S. PATENT DOCUMENTS

| | | | |
|---|---|---|---|
| Re. 29,223 | 5/1977 | Pritulsky | 339/75 MP |
| 2,699,527 | 1/1955 | Kamowski | 324/19 |
| 3,022,481 | 2/1962 | Stepoway | 339/75 |
| 3,130,351 | 4/1964 | Giel | 317/101 |
| 3,172,718 | 3/1965 | Lalonde | 339/176 |
| 3,173,737 | 3/1965 | Kinkaid et al. | 339/176 |
| 3,243,761 | 3/1966 | Piorunneck | 439/634 |
| 3,283,291 | 11/1966 | Krol et al. | 339/276 |
| 3,289,148 | 11/1966 | Antes | 339/176 |
| 3,399,372 | 8/1968 | Uberbacher | 339/17 |
| 3,417,362 | 12/1968 | Reynolds | 339/17 |
| 3,464,054 | 8/1969 | Mansfield | 339/176 |
| 3,504,330 | 3/1970 | Holzhaeuser | 339/176 |
| 3,518,610 | 6/1970 | Goodman et al. | 339/17 |
| 3,526,869 | 9/1970 | Conrad et al. | 339/75 |
| 3,530,422 | 9/1970 | Goodman | 339/17 |
| 3,553,630 | 1/1971 | Scheingold et al. | 339/74 |
| 3,614,714 | 10/1971 | Silverstein | 339/186 M |
| 3,665,375 | 5/1972 | Thoms et al. | 339/192 R |
| 3,673,548 | 6/1972 | Mattingly, Jr. et al. | 339/186 M |
| 3,683,317 | 8/1972 | Walkup | 339/75 MP |
| 3,737,838 | 6/1973 | Mattingly, Jr. et al. | 339/186 M |
| 3,742,362 | 6/1973 | Cairns et al. | 339/252 R |
| 3,783,433 | 1/1974 | Kurtz et al. | 439/637 |
| 3,797,108 | 3/1974 | Healy et al. | 29/630 C |
| 3,818,280 | 6/1974 | Smith et al. | 317/101 DH |
| 3,866,999 | 2/1975 | Doherty, Jr. | 339/17 CF |
| 3,868,166 | 2/1975 | Ammon | 339/176 MP |
| 3,899,234 | 8/1975 | Yeager et al. | 339/74 R |
| 3,975,076 | 8/1976 | Shida et al. | 339/17 L |
| 3,989,344 | 11/1976 | Pechard et al. | 339/176 MP |
| 4,045,114 | 8/1977 | Dechelette | 339/210 M |

(List continued on next page.)

*Primary Examiner*—Neil Abrams

*Attorney, Agent, or Firm*—Perman & Green

[57] ABSTRACT

An electrical connector for mechanically and electrically connecting a mother printed circuit board and a removable daughter printed circuit board of the card edge connection type. The connector has a housing with a slot for receiving an edge of the daughter board and two rows of contact chambers for receiving and holding individual contacts therein. The connector also comprises a plurality of a first type of contact having a contact area formed from a bulging bight having a coined contact surface, the curve of the bight and the curve of the crown producing a compound radii. The first type of contact also has a relatively straight angled section above the bight for initially contacting a leading edge of the daughter board with a relatively smooth transition between the angled section and the bulging bight to wedge the contacts outward from the housing slot without substantial risk of damaging the contacts, and the bulging bight allowing only the compound radii surface of the contact to contact the daughter board at an inserted home position.

19 Claims, 4 Drawing Sheets

FOREIGN PATENT DOCUMENTS

| | | |
|---|---|---|
| 419821 | 1/1970 | Australia . |
| 961560 | 1/1975 | Canada . |
| 0058578 | 8/1982 | European Pat. Off. . |
| 2431914 | 1/1975 | Fed. Rep. of Germany . |
| 1048062 | 11/1966 | United Kingdom . |
| 2022329 | 12/1979 | United Kingdom . |
| 2028015 | 2/1980 | United Kingdom . |

OTHER PUBLICATIONS

"Coaxial Cable to Printed Circuit Board Connector", vol. 13, No. 6, Nov. 1970, one page, by Agard, Brearley and Jensen.

8181 New Electronics, vol. 17, No. 2, Jan. 1984, "Designing a Connector for Backplanes of the Future", M. J. Reynolds.

IBM Tech. Disclosure Bulletin, "Contractor Expansion of Electrical Connectors", vol. 30, No. 8, Jan. 1988, pp. 217–218.

High Density Plus One advertisement by Teradyne Connection Systems, Inc.

"The Connector Selector" Burndy Corporation Master Catalog, vol. 2, Chapters 10 and 11, 1986.

U.S. PATENT DOCUMENTS

| | | | |
|---|---|---|---|
| 4,045,868 | 9/1977 | Ammon et al. | 29/629 |
| 4,047,782 | 9/1977 | Yeager | 339/75 MP |
| 4,077,694 | 3/1978 | Cobaugh et al. | 339/176 MP |
| 4,080,027 | 3/1978 | Benasutti | 439/637 |
| 4,095,866 | 6/1978 | Merrill | 339/17 E |
| 4,106,841 | 8/1978 | Vladic | 339/176 M |
| 4,133,592 | 1/1979 | Cobaugh et al. | 339/17 M |
| 4,159,861 | 7/1979 | Anhalt | 339/75 MP |
| 4,165,909 | 8/1979 | Yeager et al. | 339/75 MP |
| 4,166,667 | 9/1979 | Griffin | 339/176 MP |
| 4,179,177 | 12/1979 | Lapraik | 339/74 R |
| 4,184,735 | 1/1980 | Ammon et al. | 339/217 S |
| 4,226,496 | 10/1980 | Langham | 339/176 MP |
| 4,239,323 | 12/1980 | Tamburro | 339/186 M |
| 4,285,565 | 8/1981 | Kirby | 439/637 |
| 4,298,237 | 11/1981 | Griffith et al. | 339/17 L |
| 4,303,294 | 12/1981 | Hamsher, Jr. et al. | 339/74 R |
| 4,343,523 | 8/1982 | Cairns et al. | 339/59 M |
| 4,403,819 | 9/1983 | Weber | 339/75 MP |
| 4,431,252 | 2/1984 | Cairns et al. | 339/176 MP |
| 4,487,468 | 12/1984 | Fedder et al. | 339/75 MP |
| 4,546,414 | 10/1985 | Donges | 361/413 |
| 4,546,542 | 10/1985 | Proud | 29/874 |
| 4,561,712 | 12/1985 | Borne et al. | 339/33 |
| 4,636,021 | 1/1987 | Bobb et al. | 339/75 MP |
| 4,645,279 | 2/1987 | Grabbe et al. | 339/17 CF |
| 4,655,518 | 4/1987 | Johnson et al. | 339/17 LC |
| 4,684,194 | 8/1987 | Jenkins et al. | 439/260 |
| 4,705,338 | 11/1987 | Sitzler | 439/260 |
| 4,720,156 | 1/1988 | Beers | 439/260 |
| 4,734,041 | 3/1988 | Bruchmann et al. | 439/637 |
| 4,806,103 | 2/1989 | Kniese et al. | 439/60 |
| 4,846,734 | 7/1989 | Lytle | 439/637 |
| 4,869,672 | 9/1989 | Andrews, Jr. | 439/60 |

CARD EDGE CONNECTOR

CROSS-REFERENCE TO RELATED APPLICATIONS

This is a continuation-in-part of copending Ser. No. 07/324,388 filed Mar. 15, 1989, now abandoned, which is a divisional of Ser. No. 07/146,858 filed Jan. 22, 1988, now U.S. Pat. No. 4,846,734.

BACKGROUND OF THE INVENTION

1. Field of the Invention

This invention relates to electrical connectors and, more particularly, to electrical contacts in connectors for connection to traces on an edge of a daughter printed circuit board.

2. Prior Art

In the electrical arts it is a common practice to use a connector to mechanically and electrically couple a mother printed circuit board with a daughter printed circuit board as of the vertical edge card variety. In such a practice, there has been an evolution towards placing electrical contacts closer and closer together while maintaining a high, constant stress between the electrical contacts and the areas to be contacted. In placing the contacts closer together, as to 20 contacts per linear inch, the width of each contact must decrease. This, in turn, makes it much more difficult to keep the proper contact stress between the contact and the areas to be contacted on the edge card while also assuring proper alignment between the two upon insertion of the edge card into the connector. One approach in the past was to apply a spherical dimple stamped into the contact.

In the past, there have been used connector contacts with dimples and without dimples. In addition, crowns have been placed on certain types of larger contacts as by the coining process. Also in the past, a wide variety of materials have been used as contacts and a wide variety of techniques have been used for assembling the contacts into the housing for pre-stressing purposes. Nowhere in the prior art, however, is there a connector with contacts of the reduced sizes and with the increased, constant stresses to achieve the performance as described and claimed therein. Although many prior advances are noteworthy to one extent or another, none achieves the objective of an effective, efficient, compact and economical connector with contacts, each having a coined bend and a contact area formed of compound radii.

Another problem that has arisen with prior art card edge connectors is that, due to the relatively small size of contacts and connectors, when an edge of a daughter board is inserted into a connector, the contacts may not actually contact the daughter board on the contacts' intended contact area. This is because, as the contact is pushed away by the daughter board, the contact changes shape and/or orientation, at least partially. This can result in an area of the contacts, other than the intended contact area, contacting the daughter board and potentially not providing the desired contact stress against the daughter board.

Another problem that has arisen with prior art card edge connectors is that, because of the relatively small size of contacts and connectors, a daughter board being inserted into a connector can damage the contacts in the connector if the leading edge of the daughter board jams against a top portion of the contacts without the contacts moving out of the way fast enough.

It is therefore an objective of the present invention to provide a new and improved contact and connector that can overcome the above problems in the prior art as well as provide additional features and advantages.

SUMMARY OF THE INVENTION

The foregoing problems are overcome and other advantages are provided by a new and improved electrical contact for use in a connector for mechanically and electrically connecting a mother printed circuit board and a removable daughter printed circuit board of the card edge connection type.

In accordance with one embodiment of the invention, an electrical contact is provided for use in a connector comprising a housing with an electrically insulating material having a slot for receiving an edge of a daughter printed circuit board and two rows of contacts chambers for receiving and holding individual contacts therein, each chamber having a top prestress portion between the chamber and the slot, the contact being comprised of an electrically conductive material and being positionable in one of the contact chambers. The contact further comprising a first portion, a second portion, a third portion, and a fourth portion. The first portion is formed as a solder tail extendable from the housing for coupling with a mother printed circuit board. The second portion extends from the first portion and is positionable in the housing and has an angled section therewith. The third portion comprises a humped bight with an outer face on a first side forming a contact area. The third portion extending from the second portion and being extendable from the chamber into the slot. The fourth portion extends from the third portion and has a relatively constant sloped angled section and a prestress tip section. The tip section can contact the top prestress portion of the housing in a home position and the relatively constant slope angled section extends between the tip section and the third portion. With the contact inserted in the housing, upon insertion of a daughter printed circuit board into the housing slot, a leading edge of the daughter board will initially contact the relatively constant slope angled section of the contact and push the third portion, at least partially, out of the slot such that the daughter board leading edge can pass beyond the contact area with the outer face of the third portion contacting a trace on the daughter board without substantial risk of the leading edge of the daughter board damaging the contact as the leading edge presses against the fourth portion and without risk of the trace on the daughter board being contacted by the second portion rather than the bight outer face.

In accordance with another embodiment of the present invention, in an electrical connector for use in mechanically and electrically connecting a mother printed circuit board and a removable daughter printed circuit board of the card edge connection type, the connector having a housing of dielectric material with a slot for receiving an edge of a daughter printed circuit board and two rows of contact chambers for receiving and holding individual contacts therein, each chamber having a top prestressed portion between the chambers and the slot, and a plurality of contacts, each contact being located in one of the contact chambers and having a first portion formed as a solder tail, a second portion having an angled section, a third portion having a bight, and a fourth portion having a prestress tip section, wherein the improvement comprises the fourth portion having a substantially straight angled section between the prestressed tip section and the third portion, the angled section extending into the housing slot from the contact chamber at an angle of about 30° relative to sidewalls of the housing slot such that upon insertion of a leading edge of a daughter printed circuit board into the housing slot, the leading edge of the daughter board will initially contact the fourth portion angled section and, at least partially, wedge the contacts outward from the housing slot without substantial risk of damaging the contacts.

In accordance with another embodiment of the present invention, an electrical connector for mechanically and electrically connecting a mother printed circuit board and a removable daughter printed circuit board of the edge card connection type is provided. The connector comprises a housing and a plurality of a first type of contacts. The housing comprises an electrically insulating material having a slot for receiving an edge of a daughter printed circuit board and two rows of contact chambers for receiving and holding individual contacts therein. Each chamber has a back wall, an aperture into the slot, and a top prestress portion between the chambers and the slot. The plurality of a first type of contact are comprised of an electrically conductive material and each of the contacts being located in an individual one of the contact chambers. Each contact comprises a first portion, a second portion, a third portion, and a fourth portion. The first portion is formed as a solder tail extending from the housing for coupling with a mother printed circuit board. The second portion extends from the first portion into the housing and has an angled section therewith. The second portion angled section extending away from the chamber back wall at a relatively small angle. The third portion comprises a bight with an outer face on a first side of the contact forming a contact area, the third portion extending from the second portion in the chamber into the slot and having a substantially bulging profile into the slot from the second portion. The fourth portion extends from the third portion and has a relatively straight angled section and a prestressed tip section. The tip section contacts the top prestress portion of the housing in a home position and the relatively straight angled section extending between the tip section and the third portion with a relatively smooth transition therebetween. Upon insertion of a daughter printed circuit board into the housing slot, a leading edge of the daughter board will initially contact the relatively straight angled section of the contacts and push the third portions, at least partially, out of the slot such that the daughter board leading edge can pass beyond the contact areas with the outer faces of the bights contacting traces on the daughter board without substantial risk of the leading edge of the daughter board damaging the contacts at the leading edge presses against the fourth portions and without risk of the traces on the daughter board being contacted by the contact second portions rather than the contact areas.

BRIEF DESCRIPTION OF THE DRAWINGS

The foregoing aspects and other features of the invention are explained in the following description, taken in connection with the accompanying drawings, wherein.

DETAILED DESCRIPTION OF THE INVENTION

Figure 7:
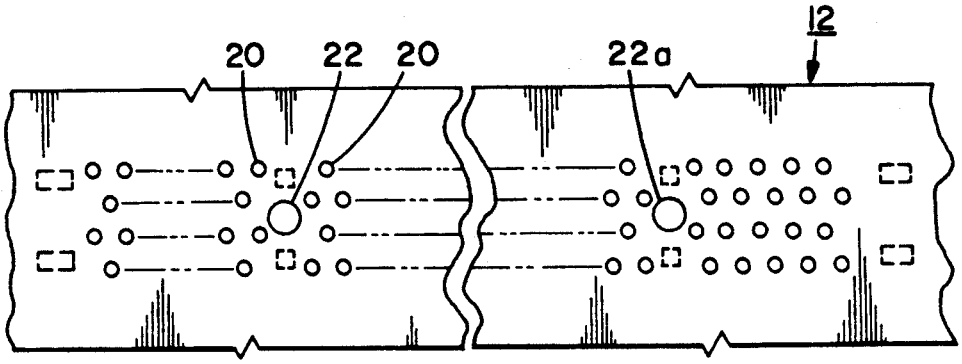
FIG. 7 is a pan view of a portion of the mother printed circuit board to which the connector of the present invention may be coupled.
Figure 8:
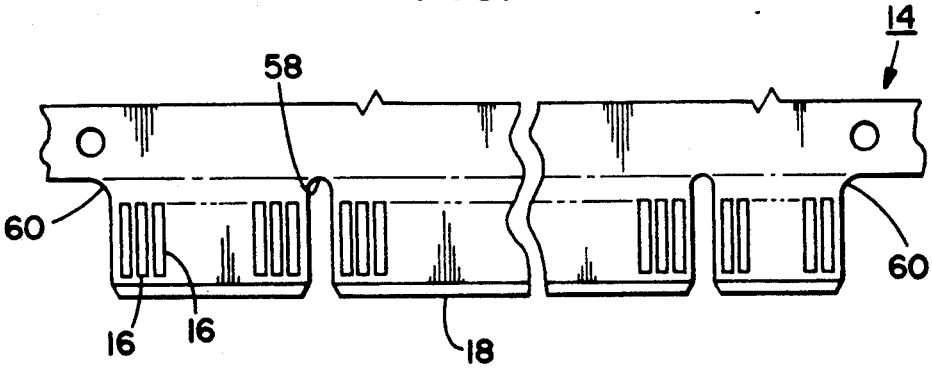
FIG. 8 is a front elevational view of a portion of the daughter printed circuit board of the edge card type adapted to be received by the connector of the present invention.

Shown in the various Figures is an edge card connector 10 adapted to couple a mother printed circuit board 12 with a daughter printed circuit board 14 of the edge card type. A portion of a typical mother printed circuit board 12 is shown in FIG. 7 while a typical edge card type daughter printed circuit board 14 is shown in FIG. 8. For the sake of illustration only, the mother printed circuit board is shown with apertures 20 at the ends of its electrical traces for receiving the coupled electrical element such as the connector of the present invention. Enlarged apertures 22 and **22*a* are also included for mechanically attaching the connector 10 with the board 12. It should be understood, however, that a surface mount connection with soldering could be utilized for the coupling between connector and board. A portion of the daughter printed circuit board 14 is illustrated in FIG. 8 with aligned parallel contacts 16 shown. This is that portion of the daughter board adapted to be releasably coupled with the connector 10 of the instant invention whereby the individual traces 16 along one edge 18 may be coupled with the individual contacts of the connector for coupling the mother and daughter printed circuit boards 12 and 14**.

Figure 1:
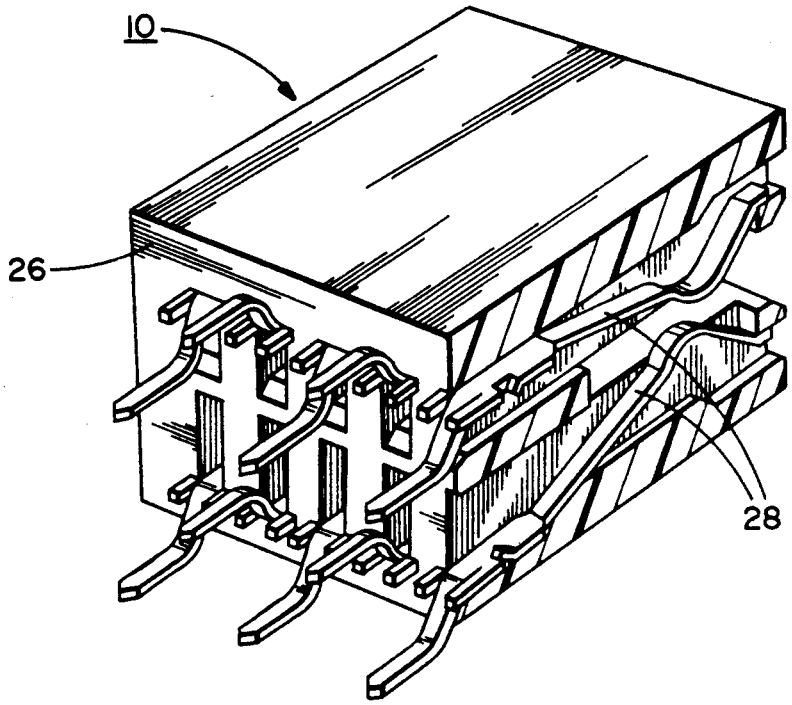
FIG. 1 is an enlarged partial perspective illustration of the connector constructed in accordance with the present invention with parts removed to show certain internal constructions thereof.
Figure 2:
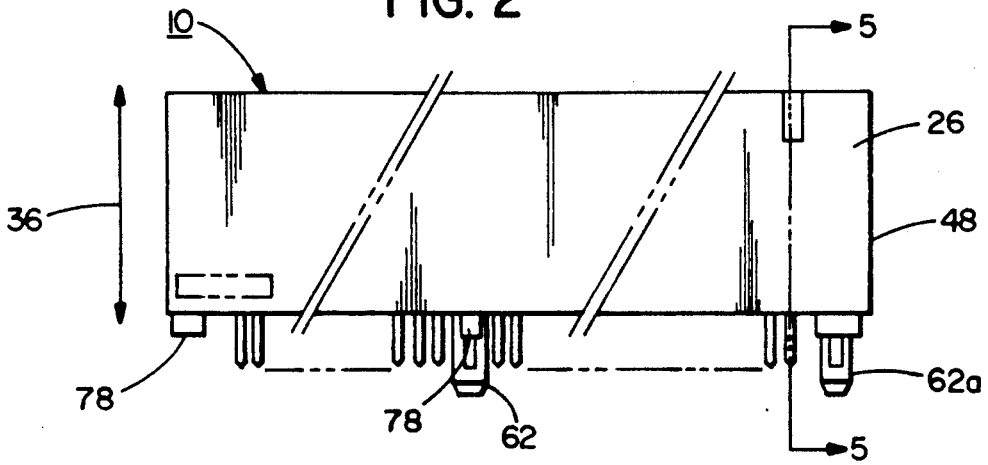
FIG. 2 is a front elevational view of the connector shown in FIG. 1.
Figure 4:
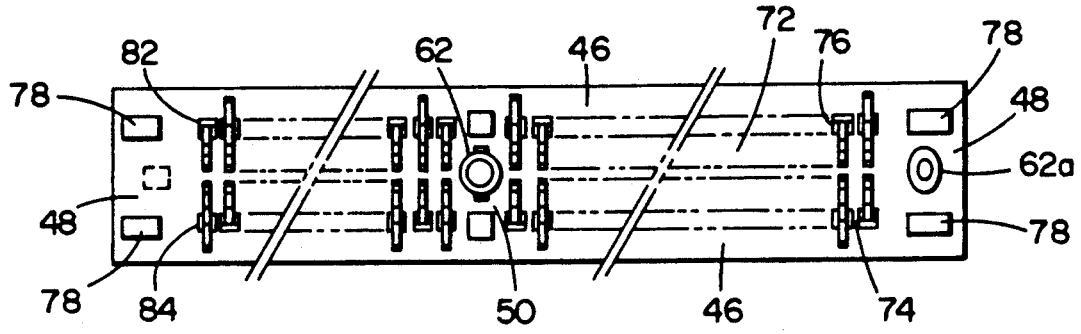
FIG. 4 is a bottom view of the connector shown in FIG. 2.

The connector 10 is comprised of two basic types of components, an electrically insulating housing 26 and a plurality of electrically conductive contacts 28. The contacts 28 function to transmit electrical current, either signals or power, between the daughter board 14 and the mother board 12. The housing 26 supports the daughter board on the mother board and supports the individual contacts 28 in the proper electrically isolated position, with respect to each other. The housing is a generally rectangular member molded of a conventional electrical insulator such as RYTON R-4, RYTON R-7, or RYTON R-404. RYTON is a trademark of the Phillips 66 Company of Pasadena, Texas. The housing 26 has an extended length 34 largely determined by the number of contacts 28 to be supported. Its height 36, through the majority of its extent, is slightly less than the lengths of the supported contacts 28. Its thickness 38 is relatively thin, being merely sufficient to retain the two rows of opposed contacts with a space or slot 42 therebetween for receiving the edge 18 of the daughter board 14 (note the cross-sectional configuration of FIG. 5). The majority of the bulk of the housing 26 is comprised of essentially parallel side walls or back walls 46 extending the entire length of the housing. End walls 48, formed integrally at the ends of the side walls, couple the side walls 46 and are of sufficient thickness to add rigidity to the housing. One or more intermediate walls 50 may be spaced periodically along the length of the side walls parallel with the end walls for further rigidity. The side walls 46 and intermediate walls 50 have upper edges 54 and 56 while the daughter printed circuit board has recesses 58 and 60. The asymmetric location of the intermediate wall 50 and intermediate cutout 58 precludes the improper locating of the daughter printed circuit board 14 into the slot 42. Depending projections or posts 62 and **62*a* extent downwardly from the intermediate and end walls for providing a mechanical coupling with the mother circuit board 12. The posts 62 and 62*a* may be provided with different characteristics for proper orientation with the mother board 12. For instance, the diameters of posts 62 and 62*a* can be different, as shown in FIG. 2, to provide proper orientation to the mother board 12. Also, the shape of posts 62 and 62*a* can be different, as shown in FIG. 4**, for the same purpose.

A pair of parallel upper bearing strips or shelves 64 extend from end wall to end wall of the housing. Spacer bars 66 are periodically located between the shelves 64 and their associated side walls 46 to define apertures 68 for receiving the upper edge portions of the individual contacts 28. The upper interior edges of the shelves 64 are beveled for guiding the lower edge of a daughter printed circuit board 14 into the slot 42. The lower face of the housing is also provided with a longitudinal support bar 72 and spacer bars 74 defining apertures or channels 76 for separating the lower edges of the individual contacts 28. Standoffs 78 are formed into the lower face of the connector housing 26 to maintain the housing 26 at a predetermined distance from the mother printed circuit board 12 for functioning as a washway to allow the flow of fluid therefrom as is necessary during the soldering of the contact solder tails to the mother printed circuit board 12.

Figure 5:
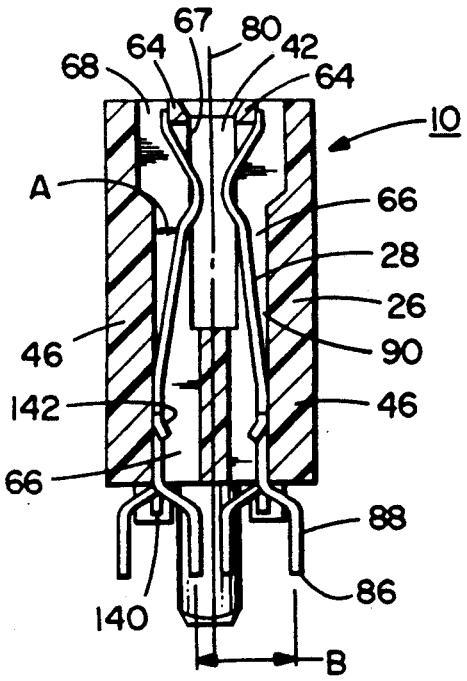
FIG. 5 is a sectional view of the connector shown in FIG. 2 taken along line 5—5.
Figure 6:
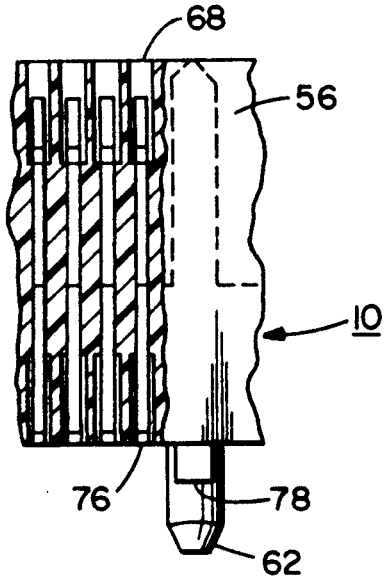
FIG. 6 is a partially fragmented view of a portion of the connector housing shown in FIG. 2.

The connector 10 essentially has two symmetric halves on opposite sides of a vertical central plane 80, shown in FIG. 5. The use of a vertical central plane and the illustration of an upstanding connector and daughter printed circuit board 14 in combination with a horizontal mother circuit board 12 are done for descriptive purposes only. It should be understood that the present invention could be practiced at virtually any angular and planar orientation with respect to the horizontal or vertical.

Supported within the housing 26 are a plurality of individual electrical contacts 28. The contacts 28 are arranged in two essentially parallel rows 82 and 84 generally symmetric about the vertical central plane 80. The lower ends 86 of each contact 28 terminate in solder tails 88. The solder tails 88 of each pair of contacts are offset from the solder tails of each adjacent pair of contacts (note FIG. 4). The solder tails 88 are adapted to be coupled with the electrical traces (not shown) of the mother printed circuit board 12 through apertures 20. As shown in FIG. 7, the through-hole technique is disclosed herein. It should be appreciated, however, that surface mount couplings can just as easily be utilized.

Figure 3:
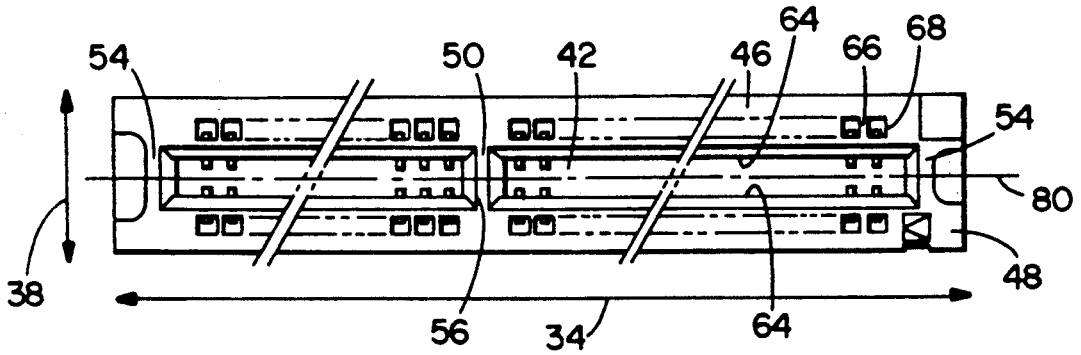
FIG. 3 is a top plan view of the connector shown in FIG. 2.

The contacts 28 have second portions 30 that extend upwardly from the solder tails 88 into the housing (see FIG. 5) where they have angled intermediate sections 90 bending from the side walls 46 toward the central plane 80. In the embodiment shown, the angled sections 90 extend away from the interior surface of the side walls 46 at a relatively small angle A of about 10 degrees. However, any suitable angle can be provided. Located at the end of the second portions of the contacts 28 is a third portion 95 having a bulging bight or hump 97. In the embodiment shown, the second portions 30 of the contacts are suitably sized, shaped and their angles A sufficiently small such that the second portions 30 do not enter the slot 42 at their home position shown in FIG. 5. Rather, the bulging bight 97 extends into the slot 42 with a relatively sharp transition between the second and third portions. Front or outer faces 102 of the contacts, facing the central plane 80, at the bulging bight 97 are coined as will be described below. Located at the bulging bight 97 of each contact is a contact area or section 96 for making mechanical as well as electrical contact with the traces 16 of the daughter printed circuit board 14. Located at the top of the third portions 95 are fourth portions 92 comprising relatively straight angled sections 93 and prestress tip sections 98. The contacts extend upwardly where the uppermost parts 98 are received in individual apertures 68 defined by the side walls 46, shelves 64 and spacer bars 66, as shown in FIG. 3. The individual contacts at their upper ends 94 are constrained from lateral movement by the spacer bars 66. The spacer bars 66 limit the degree of lateral movement of the upper ends of the contacts as during the insertion of a daughter printed circuit board into the connector 10 as well as during removal of a daughter board therefrom. The individual contacts 28 are effectively spring loaded or prestressed within the housing 26 against the shelves 64 limiting the movement of opposing contacts toward each other.

In the embodiment shown, the relatively straight or constant slope angled section 93 of each contact 28 extends between the third portion 95 and the prestress tip section 98. The angled section 93 projects from the aperture 68 into the slot 42 at an angle of between about 40 degrees to about 20 degrees with a preferred embodiment of about 30 degrees relative to the interior side walls 67 in the slot 42 formed by spacer bars 66. In the embodiment shown, the transition between the third and fourth portions of the contacts is relatively gentle or smooth, especially on the outer faces 102 of the contacts 28. The bulging bight 97 and the relatively straight angled section 92 help to allow proper insertion of and contact with the daughter board 14 as will be described below.

Figure 9:
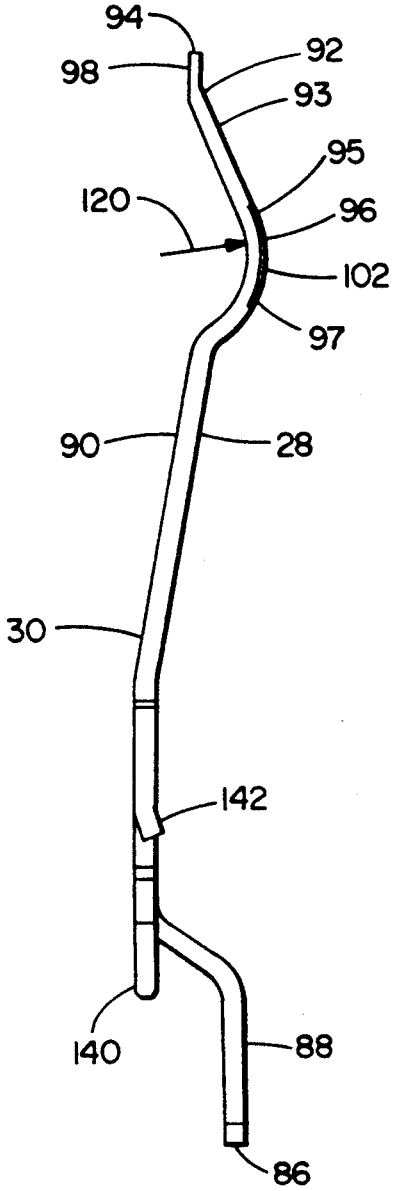
FIG. 9 is a side elevational view of one of the contacts shown in the connector of FIGS. 1 through 6.
Figure 10:
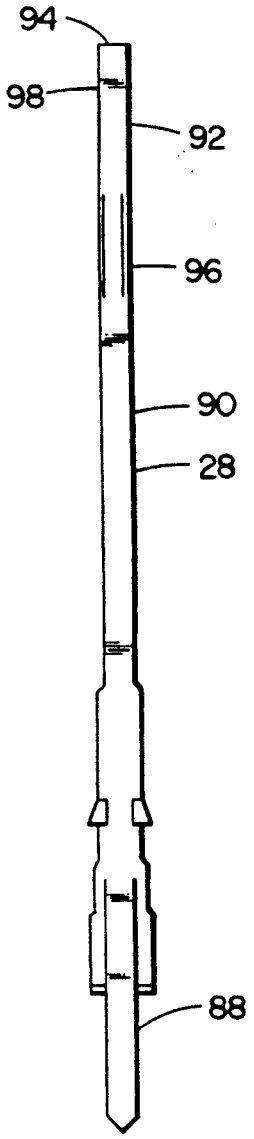
FIG. 10 is a front elevational view of the contact shown in FIG. 9.
Figure 11:
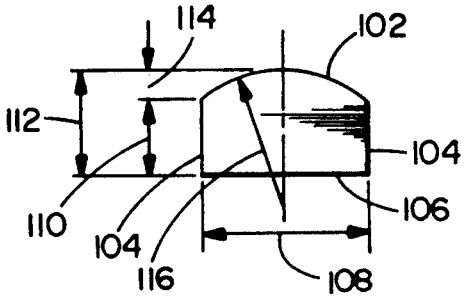
FIG. 11 is a sectional view of the contact shown in FIGS. 9 and 10 taken through the coined area.

The proper contact stress between the contact areas 96 and traces 16 is provided by a combination of a crown or non-flat surface on the bowed exterior face 102 of the contact area 96 with a radius of curvature as seen in FIG. 11, and the curve on the contact 28 at the contact area 96 with a radius of curvature as seen in FIG. 9. The crown and bight are formed by coining and bending the contact strips at the third portion 95. The outer surface 102 then has a plating placed on it such as a gold. The curve of the crown and the curve of the bight jointly provide a combination of two radii or compound radii which produce the proper stress when the contacts 28 contact the traces 16 of the daughter printed circuit board 14. The gold is used on the contact primarily for lubrication.

The contacts 28 are placed in the housing 26 and assume a free state. The prestress tip sections of the contacts 28 are then placed in their confining apertures 68 as shown in FIG. 5 whereby they are pre-stressed by hooking behind the shelves 64. The contacts 28 then are further stressed or deformed when the daughter printed circuit board 14 is inserted in slot 42 so that their upper ends 94 move off the shelves 64 thereby placing the proper amount of stress of about 200,000 psi, plus or minus 50,000 psi, on the traces 16 of the daughter printed circuit board 14. When the printed circuit board 14 is inserted in slot 42, deformation occurs on the contacts 28 and traces 16 to produce the proper contact stress. The modulus of elasticity and the poissons ratio are considered when calculating the proper stress. In this case, the modulus of elasticity is about 16 million psi and the poissons ration is about 0.3.

The cross-sectional configuration of each contact 28 is essentially rectangular at any point along its length except in the contact area or section 96 where electrical contact is made with the traces 16 of the daughter printed circuit board 14. In this area 96, the opposed radially exterior faces 102 of each contact 28 assume a convex configuration (note FIG. 11). This configuration is achieved through coining the contacts in this region rather than simply stamping them as had been the custom of the trade. The cross section has approximately parallel side edges 104 and a perpendicular radially interior face 106. The bowed exterior face 102 extends outwardly from the edges 104. In the contact area 96, the surface of the contact bends about a radius of curvature 120 between about 0.061 and 0.067 inches. The crown or non-flat surface on the exterior face 102 is substantially uniform along a predetermined length of the bowed exterior face 102. However, any suitable length of the non-flat surface or crown on the bowed exterior face 102 may be provided. In a preferred embodiment, the non-flat surface or crown is provided along substantially the entire length of the exterior face 102 at the contact area 96 as shown in FIG. 9.

The individual contacts 28 are fabricated of any conventional spring material such as metal, preferably phosphor bronze. Each contact is plated with nickel to a thickness of about between 0.000050 and 0.000150 inches. The solder tails are coated with solder of about 60 parts tin and 40 parts lead to a thickness of about between 0.000100 and 0.000500 inches. In the contact area a coating of gold at about 0.000004 inches nominally is plated over about 0.000040 inches minimum of about 80 parts palladium and 20 parts nickel. All of the platings include the plating of all surfaces or sides except in the contact area wherein the plating need only occur on that surface to contact the daughter printed circuit board.

Figure 12:
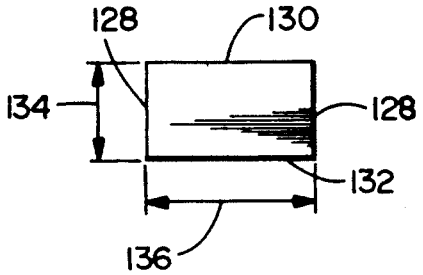
FIG. 12 is a sectional view of the contact shown in FIGS. 9 and 10 but taken on either side of the coined area.

Referring principally to FIGS. 9, 11 and 12, the contacts 28 have a cross-sectional shape as shown in FIG. 12 at their first and second portions and at the angled portion 93. The third portion 95 has a cross-section shape as shown in FIG. 11 at the contact area 96. Generally, the contacts have a width 136 and thickness 134. The width 136 is about 0.018 to about 0.022 inches. The thickness 134 is substantially constant except at the upper ends 94 which is tapered to prevent contact or minimize contact with side walls 46 when a daughter board is inserted in slot 42. The contacts have relatively flat side edges 128 and relatively flat first and second facts 130 and 132. During the coining process at the third portion 95, the initial width 136 of the contacts is slightly increased to width 108 which is about 0.024 to about 0.026 inches. The height 112 at the coined area is substantially the same as the height 134 prior to coining. However, the side edges 104 at the coined area have a length 110 which is less than the length of side edges 128 and the coined area has a rise 114 between length 110 and length 112, with a radius of curvature 116.

The use of a concentrated contact area is desired because it produces a higher contact stress by reducing the area which contacts the traces 16 on the daughter board 14. This stress is needed to break through any surface film or other debris that may be on the pad or traces 16. The stress required is approximately 200,000 psi plus or minus 50,000 psi. Creating a concentrated contact area in this fashion has in the past proved to be very difficult to do in a precisely controlled manner. If a spherical dimple is put on the contact leg first, then the subsequent bending of the leg will cause distortion in the contact area. Such distortion eliminates any control over the shape of the contact area and places on the surface an orange peel effect which is not as smooth as required. On the other hand, if the bend is put in first, then it is hard to make certain that a spherical dimple ends up at the intended location. It would thus be difficult to have the spherical dimple aligned in the center of the contact. When employing other than the method of the present invention, the spherical area may be so far out of center that it interferes with, and breaks through, the edge of the contact. These problems are amplified in connectors where the contacts are on the miniaturized 0.050 center lines as disclosed herein.

The solution to this problem is to place the high stress configuration on the contact by forming the bend in the contact and coining a surface of the contact at the bend during manufacturing, resulting in the desired compound surface. In the embodiment disclosed above, two other problems with the prior art are corrected; the problem of the contact being so deformed by an edge of a daughter board that the traces 16 of the daughter board are not contacted properly by the contact surface at the contact area, and the problem of the leading edge of a daughter board damaging the contacts because at initial contact between the two, the contacts do not deflect out of the way of the edge of the daughter board fast enough or the leading edge is jammed against at an area in the card edge insertion slot at which the contacts are poorly curved. The present invention provides the bulging bight 97 such that, even thought the contacts 28 will be deformed or bent back by an inserted portion of daughter board 14, under no circumstances can an area other than the contact surface at the contact area 96 contact the daughter board traces 16 after the board is fully inserted. The extreme or substantial transition between the second and third portions of the contacts is especially needed because of the relatively small angle A and length of the second portion angled section 90; even minor deformation of the contact resulting in significant changes to the relative orientation of portions of the contacts. The bulging bight 97 prevents the second portion angled section 90 from contacting the daughter board traces 16 under virtually all circumstances. In addition, the fact that the second portion angled section 90 never enters the slot 42 insures that only the contact area 96 will contact the traces 16.

In the embodiment shown, the straight angled section 93 and relatively smooth transition between the angled section 93 and contact area 96 combine to insure that when a leading edge of a daughter board is inserted into the slot 42, the contacts 28 will deflect out of its path without being damaged. Generally, because the angled section 93 extends from the contact chambers into the slot 42 and have a relatively small angle of about 30 degrees relative to the slot walls and direction of daughter board insertion, it is virtually impossible for the leading edge of the daughter board to get jammed on the angled section 93 or not deflect the contacts 28 quickly enough to prevent damage to the contacts 28. In addition, the relatively smooth transition between the third and fourth portions further aids to preventing damage to the contacts, especially with the transition of the crowned surface and the flat surface on the exterior face 102.

The method of fabricating the electrical contact thus comprises the steps of initially providing an elongated strip of electrically conductive material stamped from a sheet with a lower portion and an upper portion. The strip is then deformed by coining at an intermediate contact area between the lower and upper portions. The strip is bent at the intermediate contact area to form a bight with a radially interior face and a radially exterior face. The coined area is on the radially exterior face of the bent strip for contacting a trace 16 of the daughter board to be electrically coupled with the contact.

The method further includes the step of fabricating the contact of phosphor bronze and plating the strip with nickel to a thickness of about between 0.000050 and 0.000150 inches. The method further includes the step of plating the lower portion of the contact with solder of about 60 percent tin and 40 percent lead to a thickness of about between 0.000100 and 0.000500 inches to ensure a proper soldering contact with the mother board. Lastly, the contact area of the contact is plated with about 40 microinches or thicker PdNi flashed with gold to a thickness of about 0.000004 inches nominally. Alternatively, the area can be plated with about 30 microinches or thicker gold.

What had to be done differently from the prior design and fabrication of the miniaturized 0.050 inch contact array in the slot 42 as disclosed herein was to redesign the radius and the crown with certain stringent requirements to make the system operable. The resulting area of contact that is produced between the contact strip and the daughter board traces is approximately elliptical in shape. The resulting area within the ellipse is controlled and reproducible. Because of the closeness of the contacts and their relatively reduced widths compared to the prior art devices, it was difficult to avoid the possibility of cross-connections and arcing in the area of contact. The locating posts 62, as discussed hereinabove, assists the housing to assure that a proper alignment takes place over such tight spacing. This is especially true for the embodiment shown in the drawings wherein the spacing B between opposing solder tails 88 in each row 82 and 84 (See FIG. 5) is about 0.10 inch wherein prior art a spacing of about 0.15 inch. In order to obtain this relatively small spacing of opposing solder tails 88, the second portions 30 of opposing contacts are located closer to each other in the housing than in prior art connectors. Because the housing slot 42 is substantially the same size as in prior art connectors and the second portions are closer together, the angle A for the present invention has been reduced to about 10 degrees. However, because the contact areas of the contacts 28 are being displaced from the slot 42 by a daughter board substantially the same amount as in prior art connectors, and the angle A is so relatively small, if the contacts 28 did not have a relatively sharp transition between the second and third portions, when a daughter board was inserted the second portions of the contacts, due to the angle A being about 5 degrees or less after insertion and the contacts bowing or deforming slightly, could contact the traces on the daughter board rather than the contact area contacting the traces. Thus, the present invention can provide for closer spacing of solder tails by allowing the second portions of opposing rows of contacts to be positioned in the housing closer to each other, but nonetheless allow for proper contact with traces on the daughter printed circuit board. Obviously, the contacts of the present invention can be used in other types of connectors including bi-level card edge connectors.

It should be understood that the foregoing description is only illustrative of the invention. Various alternatives and modifications can be devised by those skilled in the art without departing from the spirit of the invention. Accordingly, the present invention is intended to embrace all such alternatives, modifications and variances which fall within the scope of the appended claims.

What is claimed is:

1. An electrical contact for use in a connector for mechanically and electrically connecting a mother printed circuit board and a removable daughter printed circuit board of the card edge connection type, the connector comprising a housing with an electrically insulating material having a slot for receiving an edge of a daughter printed circuit board and two rows of contact chambers for receiving and holding individual contacts therein, each chamber having a top prestress portion between said chamber and said slot, the contacts being comprised of an electrically conductive material and being positionable in one of said contract chambers and further comprising:

(a) a first portion formed as a solder tail extendable from said housing for coupling with a mother printed circuit board;

(b) a second portion extending from said first portion and is positionable in said housing and having an angled section therewith, said second portion being spaced from said slot for all positions of said contact;

(c) a third portion comprising a humped bight with a substantially small radius of curvature and an outer face on a first side forming a contact area, said third portion extending from said angled section of said second portion with a substantially acute bend and being extendable from said chamber into said slot;

(d) a fourth portion extending from said third portion and having a relatively constant slope angled section and a prestress tip section, said tip section can contact said top restress portion of said housing in a home position and said relatively constant slope angled section extending between said tip section and said third portion, a transition between said third and fourth portions comprising said angled section extending straight from said third portion such that a smooth transition is provided without a substantial bend at said transition;

wherein, upon insertion of a daughter printed circuit board into said housing slot, a leading edge of the daughter board will initially contact said relatively constant slope angled section and push said third portion, at least partially, out of said slot such that the daughter board leading edge can pass beyond said contact area with said outer face of said third portion contacting a trace on the daughter board without substantial risk of the leading edge of the daughter board damaging said contract by the leading edge pressing against said fourth portion and without risk of the trace on the daughter board being contacted by said second portion rather than said bight outer face.

2. A contact as in claim 1 wherein said third portion outer face has a coined crown therealong such that the curve of said bight and a curve of said crown combine as compound radii to provide a reduced contact area and provide an increased contact stress.

3. A contact as in claim 1 wherein said fourth portion relatively constant slope angled section extends into said housing slot at an angle of about 30 degrees relative to side walls of said slot in a home position.

4. A contact as in claim 1 wherein said first side has a relatively smooth transition between said fourth portion and said third portion.

5. A contact as in claim 1 wherein said second portion angled section extends away from a back wall of said chamber towards said slot at a relatively small angle of about 5 degrees.

6. A contact as in claim 1 wherein said second portion is suitably sized and shaped not to extend into said slot.

7. A contact as in claim 2 wherein said third portion has a second face opposite said outer face with a flat cross-sectional shape relative to said curve of said crown.

8. In an electrical connector for use in mechanically and electrically connecting a mother printed circuit board and a removable daughter printed circuit board of the card edge connection type, the connector having a housing of dielectric material with a slot and two rows of contact chambers for receiving and holding individual contacts therein, each chamber having a top prestress portion between said chamber and said slot; and a plurality of contacts, each contacts being located in one of said contact chambers and having a first portion formed as a solder tail, a second portion having an angled section, a third portion having a bight, and a fourth portion having a prestress tip section, wherein the improvement comprises:

said contacts having a first transition between said second and third portions and a second transition between said third and fourth portions, said second portion being spaced from said slot for all positions of said contact, said first transition comprising a sharp bend and said second transition comprising said fourth portion having a substantially straight angled section between said prestress tip section and said third portion and, said angled section of said fourth portion extending substantially straight from an end of said bight to form no substantial bend at said second transition, said angled section of said fourth portion extending into said housing slot from said contact chamber at an angle of about 30 degrees relative to side walls of said housing slot such that upon insertion of a leading edge of a daughter printed circuit board into said housing slot, the leading edge of the daughter board will initially contact said fourth portion angled section and, at least partially, wedge said contacts outward from said housing slot without substantial risk of damaging said contacts and without substantial risk of contacting the daughter board at the second portion.

9. A connector as in claim 8 wherein the improvement further comprises said bight having a substantially bulging profile relative to said second portion and said fourth portion substantially straight angled section and said bight having a relatively smooth transition therebetween.

10. A connector as in claim 8 wherein the improvement further comprises said third portion having a bowed exterior face at said bight having a non-flat surface.

11. A connector as in claim 10 wherein the improvement further comprises said fourth portion having an exterior face that is relatively flat and relatively smoothly transitions into said non-flat surface at a junction of said third and fourth portions.

12. A connector as in claim 10 wherein the improvement further comprises said third portion having a bowed interior face at said bight having a substantially flat surface.

13. An electrical connector for mechanically and electrically connecting a mother printed circuit board and a removable daughter printed circuit board of the card edge connection type, the connector comprising:

a housing comprising an electrically insulating material having a slot for receiving an edge of a daughter printed circuit board and two rows of contact chambers for receiving and holding individual contacts therein, each chamber having a back wall, an aperture into said slot, and a top prestress portion between said chamber and said slot; and a plurality of first type of contact comprised of an electrically conductive material, each of said contacts being located in an individual one of said contract chambers and comprising:

(a) a first portion formed as a solder tail extending from said housing for coupling with a mother printed circuit board;

(b) a second portion extending from said first portion into said housing and having an angled section therewith, said second portion angled section extending away from said chamber back wall at a relatively small angle and being spaced from said slot for all positions of the contact;

(c) a third portion comprising a bight with an outer face on a first side of said contact forming a contact area, said third portion extending from said angled section of said second portion in said chamber into said slot and having a substantially bulging profile into said slot from said second portion with a substantially sharp bend between said second and third portions;

(d) a fourth portion extending from said third portion and having a relatively straight angled section and a prestress tip section, said tip section contacting said top restress portion of said housing in a home position and said relatively straight angled section extending between said tip section and said third portion with a transition between said third and fourth portions comprising said angled section of said fourth portion extending straight from said third portion such that a smooth transition is provided without a substantial bend at said transition;

wherein, upon insertion of a daughter printed circuit board into said housing slot, a leading edge of the daughter board will initially contact said relatively straight angled section of said contacts and push said third portion, at least partially, out of said slot such that the daughter board leading edge can pass beyond said contact areas with said outer face of said bights contacting traces on the daughter board without substantial risk of the leading edge of the daughter board damaging said contract by the leading edge pressing against said fourth portions and without risk of the traces on the daughter board being contacted by said contact second portions rather than at said contact areas.

14. A connector as in claim 13 wherein said third portion outer face has a crown therealong such that a curve of said bight and a curve of said crown combine as compound radii to provide a reduced contact area and provide an increased contact stress.

15. A connector as in claim 13 wherein said fourth portion relatively constant slope angled section extends into said housing slot at an angle of about 30 degrees relative to side walls of said slot in a home position.

16. A connector as in claim 13 wherein said contact first side has a relatively smooth transition between said fourth portion and said third portion.

17. A connector as in claim 13 wherein said second portion angled section extends away from said back wall of said chamber towards said slot at a relatively small angle of about 5 degrees.

18. A connector as in claim 13 wherein said second portion is suitably sized and shaped not to extend into said slot.

19. A connector as in claim 14 wherein said third portion has a second face opposite said outer face with a flat cross-sectioned shape relative to said curve of said crown on said outer face.

* * * * *